US005609494A

United States Patent [19]

Yamaguchi et al.

[11] Patent Number: 5,609,494

[45] Date of Patent: Mar. 11, 1997

[54] CONNECTOR LEVER LOCKING MECHANISM

[75] Inventors: Noboru Yamaguchi; Kenichi Okamoto, both of Shizuoka, Japan

[73] Assignee: Yazaki Corporation, Tokyo, Japan

[21] Appl. No.: 564,941

[22] Filed: Nov. 30, 1995

[30] Foreign Application Priority Data

Nov. 30, 1994 [JP] Japan ..... 6-297486

[51] Int. Cl.[6] ..... H01R 13/62

[52] U.S. Cl. ..... 439/157

[58] Field of Search ..... 439/152–160, 439/372

[56] References Cited

U.S. PATENT DOCUMENTS

| | | | |
|---|---|---|---|
| 5,135,408 | 8/1992 | Suzuki | 439/157 |
| 5,174,785 | 12/1992 | Endo et al. | 439/157 |
| 5,238,417 | 8/1993 | Hatagishi | 439/157 |
| 5,344,194 | 9/1994 | Hatagishi et al. | 439/157 |
| 5,401,179 | 3/1995 | Shinchi et al. | 439/157 |
| 5,474,462 | 12/1995 | Yamanashi | 439/153 |

*Primary Examiner*—Neil Abrams
*Assistant Examiner*—Brian J. Biggi
*Attorney, Agent, or Firm*—Sughrue, Mion, Zinn, Macpeak & Seas

[57] ABSTRACT

A connecter lever locking mechanism in a lever-type connector which includes: a connector housing, an operation lever pivoted on the connector housing and a flexible locking portion formed on the connector housing and provided with a lock releasing operation portion. The operation lever includes a lever horizontal rod portion and a locking engagement portion formed on one surface of the lever horizontal rod portion so as to project toward the flexible locking portion. The connector housing has a tapered surface formed on an outer wall thereof so as to abut against the other surface of the lever horizontal rod portion opposite to the one surface thereof on which the locking engagement portion is formed so as to project therefrom.

3 Claims, 5 Drawing Sheets

CONNECTOR LEVER LOCKING MECHANISM

BACKGROUND OF THE INVENTION

1. Field of the Invention

The present invention relates to lever-type connectors, and particularly relates to a locking mechanism of a connector lever which is used for connecting connectors with each other and disconnecting the connected connectors by releasing a lock.

2. Background

FIGS. 4 and 5 show a conventional locking mechanism of a lever-type connector disclosed in Japanese Patent Unexamined Publication No. 6-119951.

In the lever-type connector, a fitting operation lever 33 is provided pivotally around pivots 32 on a female connector member 30, and driven pins 34 are provided outwardly projecting on opposite sides of a male connector member 31. Cam grooves 35 are formed in the fitting operation lever 33 and a locking engagement portion 37 is provided on an operation portion 36.

A locking projection 37*c* having a tapered engagement guide surface 37*a* and an engagement surface 37*b* is provided on the locking engagement portion 37 so as to project outward therefrom. A locking portion 39 is provided in a recessed portion 38 formed in an outer wall of the male connector member 31. A flexible locking plate 39*a* is provided to raise the recessed portion 38 of the locking portion 39, and a lock releasing operation portion 39*b* is formed at the upper end of the flexible locking plate 39*a* on the rear portion of the male connector member 31. A locking hole 39*c* is formed in the flexible locking plate 39*a* and a stopper 39*d* for prevention of excessive displacement is provided on the rear portion of the flexible locking plate 39*c*. A pair of reinforcing portions 39*e* are provided between the flexible locking plate 39*a* and the lock releasing operation portion 39*b* (FIG. 5).

A hood portion 40 for receiving the male connector member 31 is formed in the front portion of the female connector member 30. A pair of pin guide grooves 41 for receiving the driven pins 34 are formed in the opposite sides of the hood portion 40. The pin guide grooves 41 commicate with inlet portions 35*a* of the cam groove 35 of the fitting operation lever 33 when the fitting operation lever 33 is in its not-operated state. A notched portion 42.for the locking engagement portion 37 is formed in the upper side of the hood portion 40. The fitting operation lever 33 is kept in its erected posture in its not-operated state by a plate spring 43.

When the female connector member 30 and the male connector member 31 are to be fitted to each other, the male connector member 31 is pushed into the female connector member 30 so that the driven pins 34 enter from the pin guide grooves 41 into the cam groove 35 respectively, and then the fitting operation lever 33 is turned by the operation portion 36 so that the male connector member 31 is pulled into the hood portion 40 of the female connector member 30 through the cam grooves 35 and driven pins 34. At this time, the locking engagement portion 37 and the locking portion 39 come into engagement with each other so that the female connector member and the male connector member are kept locked together . In this locked state, if the lock releasing operation portion 39*b* is pressed in the direction of arrow P as shown in FIG. 5, the flexible locking plate 39*a* is displaced backward to release the engagement between the locking hole 39*c* and the locking projection 37*c* to thereby release the lock.

SUMMARY OF THE INVENTION

In the above conventional connector, there is a problem in that when the lock releasing operation portion is pressed in the direction P at the time of lock releasing, not only the flexible locking plate but also the lock releasing operation portion is bent, and releasing the engagement between the locking projection and the locking hole is difficult to be released. There is a further problem is that if the lock releasing operation portion, is pressed in the direction Q, the lock releasing operation portion easily disengages from the locking engagement portion, even though the lock releasing operation portion is not pressed in the direction P.

In view of the above-mentioned points, an object of the present invention is to provide a connector lever locking mechanism in which the bending of the lock releasing operation portion due to an urging force in the direction P is made less at the time of lock releasing, while the lock releasing operation portion cannot be easily released from the locking engagement portion against an urging force in the direction Q.

In order to attain the above object, according to an aspect of the present invention, the connecter lever locking mechanism in a lever-type connector includes: a connector housing; an operation lever pivoted on the connector housing; and a flexible locking portion formed on the connector housing and provided with a lock releasing operation portion; the operation lever including a lever horizontal rod portion and a locking engagement portion formed on one surface of the lever horizontal rod, portion so as to project toward the flexible locking portion, and the connector housing having a tapered surface formed on an outer wall thereof-so as to abut against the other surface of the lever horizontal rod portion opposite to the one surface thereof on which the locking engagement portion is formed.

In the above connecter lever locking mechanism in a lever-type connector, the connector housing preferably includes at least one auxiliary rib formed on the outer wall, and a tapered surface is formed on the auxiliary rib, the auxiliary rib further having a horizontal surface intersecting the tapered surface and being parallel to a direction along which the locking engagement portion projects.

In the above connecter lever locking mechanism in a lever-type connector, the auxiliary rib preferably has a tapered surface and a horizontal surface, a rear wall is parallel to the projecting direction of the locking engagement portion from the lever horizontal rod portion, and a back wall intersects the rear wall. An overlap width between the engagement hole and the locking projection is larger than each of a distance from the tapered surface to the back wall and a distance from the horizontal surface to the rear wall.

Since the auxiliary rib has such a tapered surface and such a horizontal surface, if the lever horizontal rod portion is pressed for its slantingly right backside in the state where flexible locking portion of the connector housing and the locking engagement portion of the lever horizontal rod portion are engaged with each other, the flexible locking portion and the locking engagement portion begin to move at the same time and the back wall of the lever horizontal rod portion abuts on the tapered surface so that the flexible locking portion is prevented from bending to make it unable to easily release the engagement between the flexible locking portion and the locking engagement portion. On the other hand, if the lock releasing operation portion is pressed from above, both the lever horizontal rod portion and the flexible locking portion begin to move and the flexible locking portion continues to bend even after the rear wall of the lever horizontal rod portion abuts on the horizontal surface so as to stop, thereby making it possible to easily release the engagement between the locking engagement portion and the flexible locking portion.

DETAILED DESCRIPTION OF THE PREFERRED EMBODIMENT

Now the preferred embodiment of the present invention will be described below.

Figure 1:
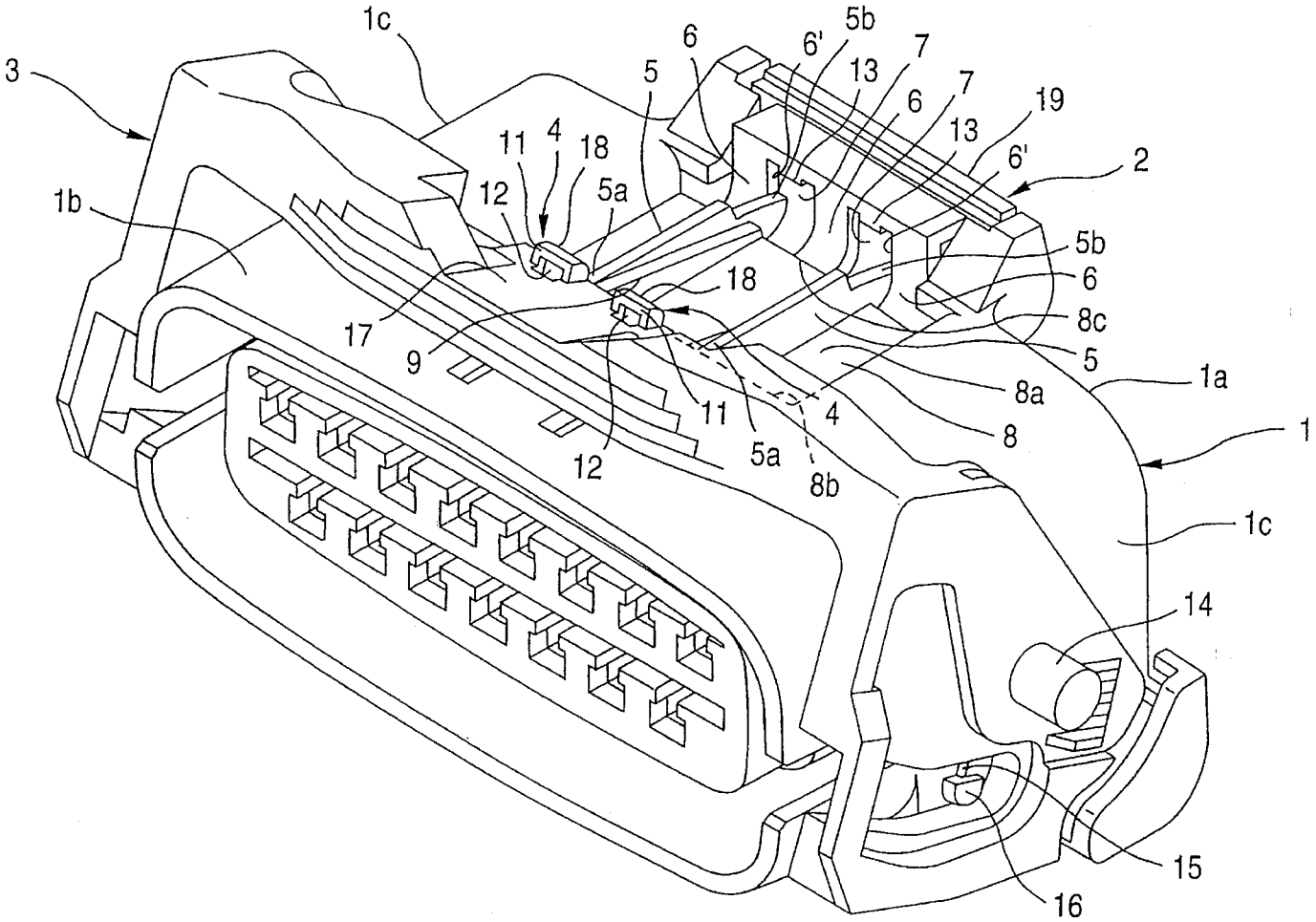
FIG. 1 is a perspective view showing an embodiment of the connector lever locking mechanism according to the present invention.
Figure 2:
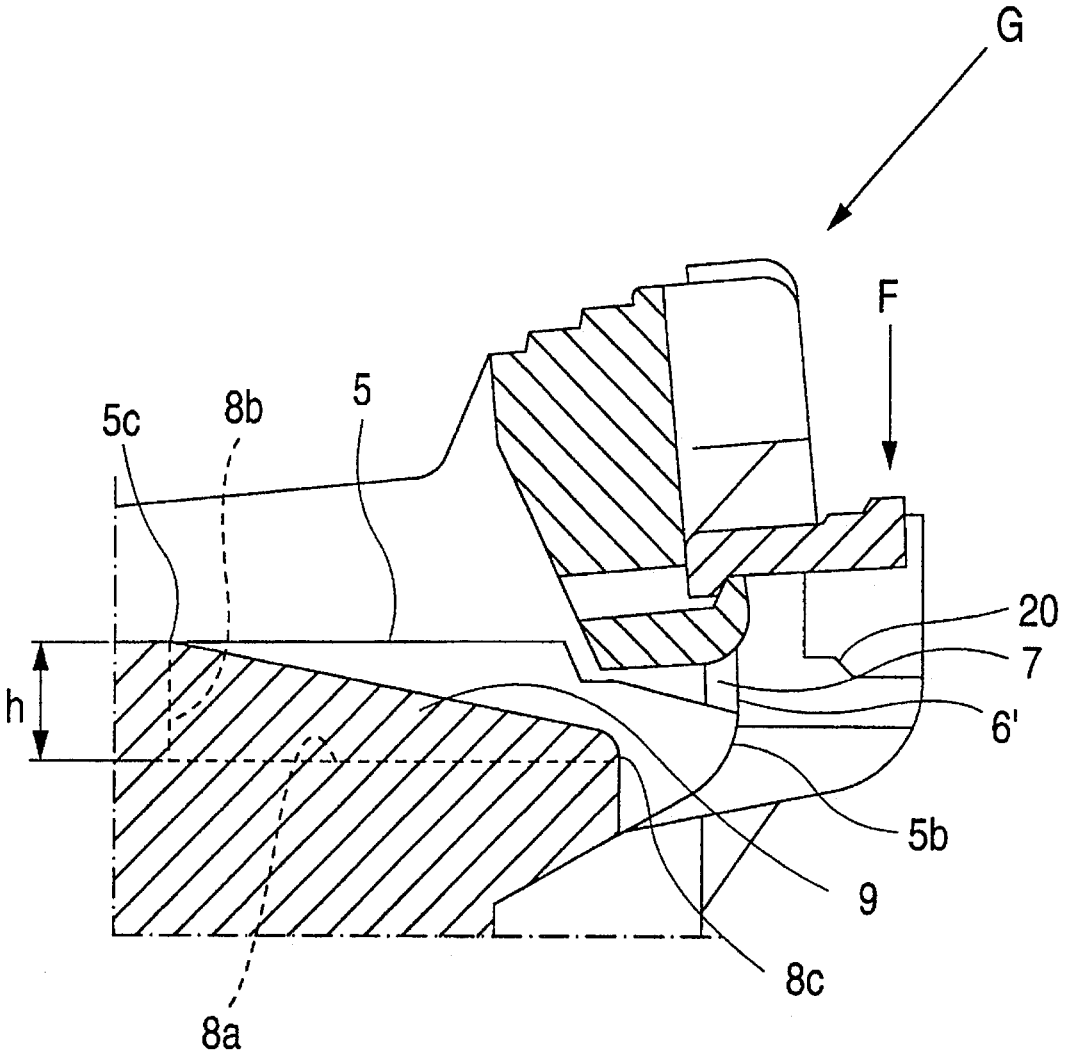
FIG. 2 is a sectional view showing a state in which engagement is made by the locking mechanism of FIG. 1.
Figure 3:
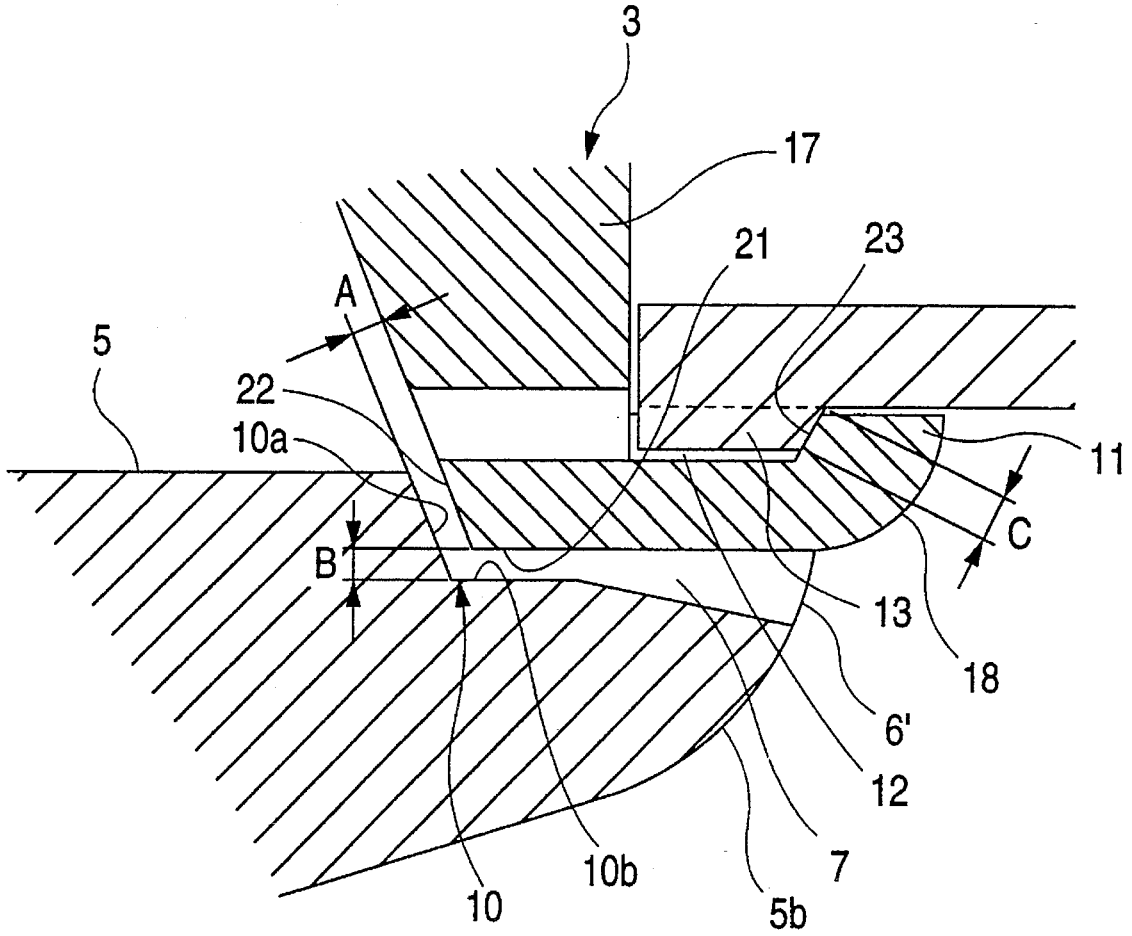
FIG. 3 is an enlarged view showing a main part of FIG. 2.
Figure 4:
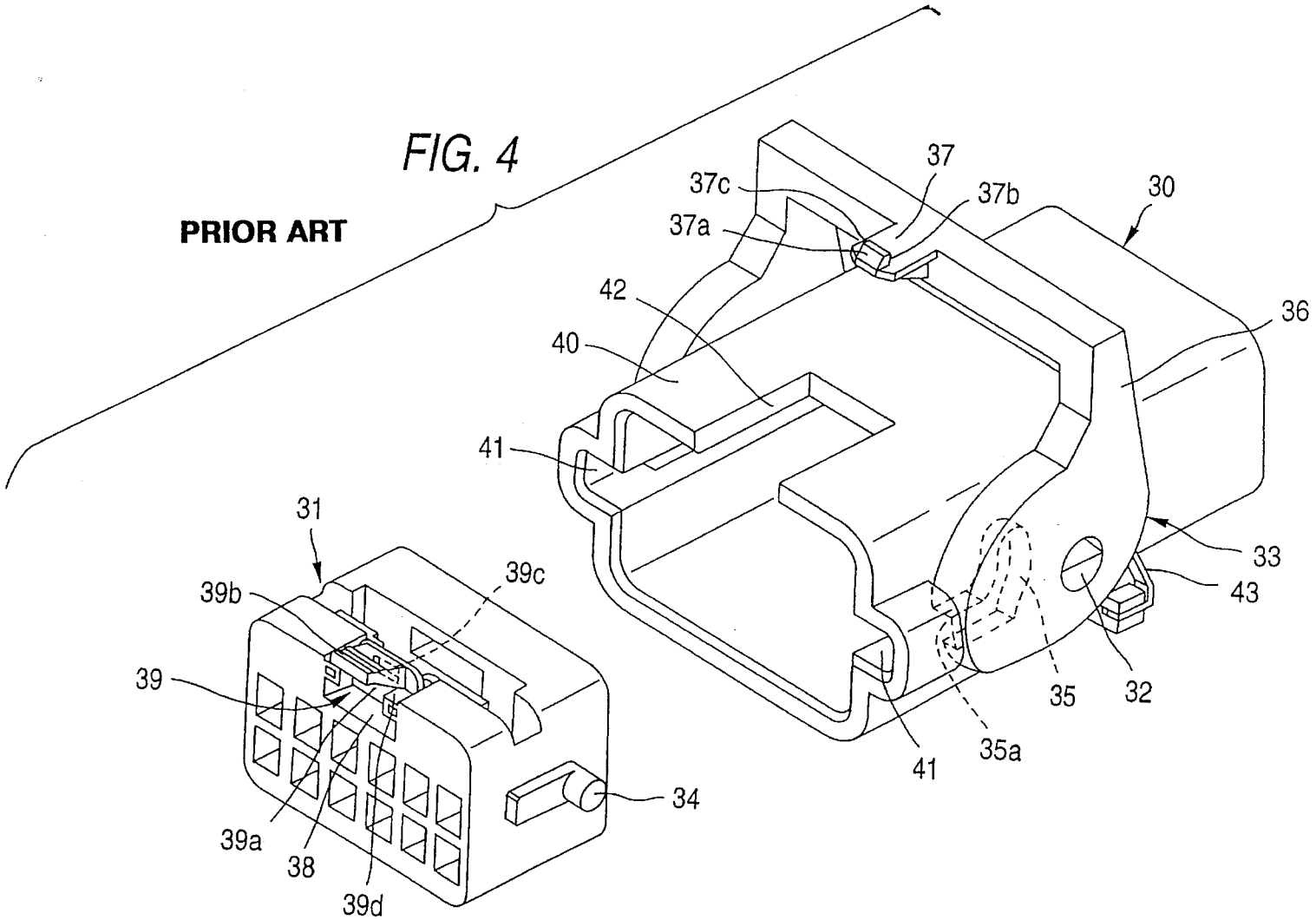
FIG. 4 PRIOR ART
FIG. 4 is a perspective view showing a locking mechanism in a conventional lever-type connector.
Figure 5:
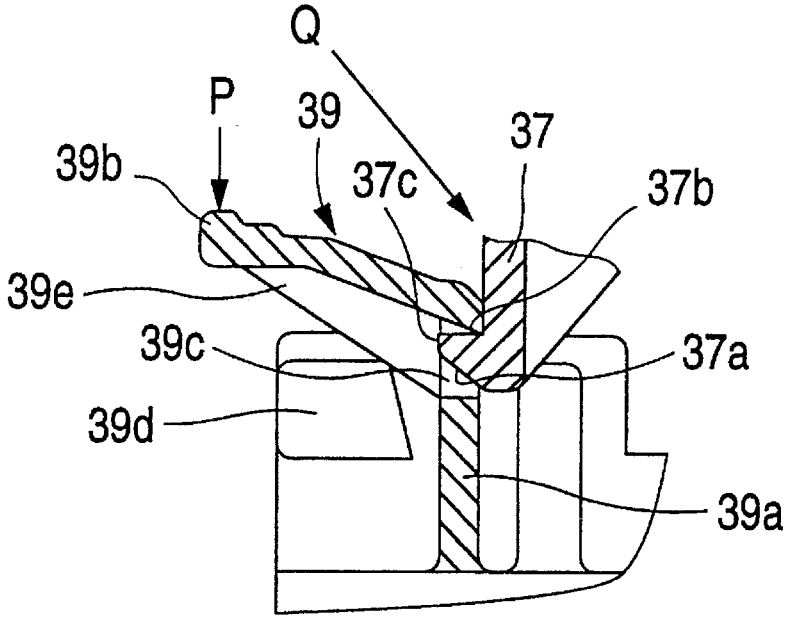
PRIOR ART FIG. 5
FIG. 5 is a sectional-view showing a state of locked connection in the conventional lever-type connector.

FIGS. 1 through 3 show an embodiment of the connector lever locking mechanism according to the present invention.

The connector lever locking mechanism has a flexible locking portion 2 provided on a rear end 1*a* of a connector housing 1, and a locking engagement portion 4 corresponding to the flexible locking portion 2 provided on an operation lever 3 so that the flexible locking portion 2 and the locking engagement portion 4 engage with each other to form the locking mechanism. A pair of auxiliary ribs 5 for assisting the hold and release operation of the locking mechanism is provided on an upper wall l*b* of the connector housing 1.

In order to form flexible locking pieces 6 in the flexible locking portion 2 and locking holes 7 between the flexible locking pieces 6 integrally with the connector housing 1, a recessed portion 8 is provided on the upper wall 1*b* of the connector housing 1 and ribs 9 are provided on the recessed portion 8. On the bottom of the recessed portion 8, the auxiliary ribs 5 are provided along the ribs 9.

As shown in FIG. 2, the auxiliary ribs 5 are provided on a bottom 8*a* of the recessed portion 8 so as to extend from a front end 8*b* of the recessed portion 8 to a rear end of the same substantially parallel to side walls l*c* of the connector housing and adjacent to the ribs 9 respectively. The height of each auxiliary rib 5 is selected to be substantially equal to the depth h of the recessed portion 8. A front end 5*a* of each auxiliary rib 5 abuts on the front end 8*b* of the recessed portion. 8 and a rear end 5*b* of the auxiliary rib 5 extended into the inside of the locking hole 7. The rear end 5*b* of the auxiliary rib 5 has a shape similar to that of a rear wall surface 6' of each flexible locking piece 6. A step portion 10 is formed between the front end 5*a* and rear end 5*b* of the auxiliary rib 5 as shown in FIG. 3. The step portion 10 is formed by a tapered surface 10*a* and a horizontal surface 10*b*. The auxiliary ribs 5 may be formed integrally with the ribs 9 when the connector housing 1 is produced, or the auxiliary ribs 5 may be formed integrally with the connector housing 1 without forming the ribs 9.

A pair of projections 11 are provided in the locking engagement portion 4, and engagement holes 12 are formed in the projections 11 respectively. In the flexible locking portion 2, locking holes 7 for the projections 11 and locking projections 13 for the engagement holes 12 are formed. When the engagement holes 12 and the locking projections 13 are fitted to each other and the projections 11 and the locking holes 7 are engaged with each other, the relation between the auxiliary ribs 5 and a lever horizontal rod portion 17 is as follows.

A rear wall 21 is parallel to the projecting direction of the locking engagement portion 4 from the lever horizontal rod portion 17, and a back wall 22 intersects the rear wall 21. The overlap width C between the engagement hole 12 and the locking projection 13 is larger than the distance A from the tapered surface 10*a* to the back wall 22 and larger than the distance B from the horizontal surface 10*b* to the rear wall 21. That is, the condition that C>A and C>B is satisfied.

As shown in FIG. 1, the operation lever 3 is rotatable by a coil spring 15 around pivots 14 which project from the opposite side walls 1*c* of the connector housing 1. One end of the coil spring 15 is locked in a spring a locking groove (not shown) formed in the operation lever 3 and the other end of the coil spring 15 is locked on a spring locking portion 16 formed on the side wall 1*c* of the connector housing 1 so that the operation lever 3 is urged by spring force against the side wall l*c* of the connector housing 1.

The operation lever 3 comprises the above-mentioned lever horizontal rod portion 17 and the above-mentioned locking engagement portion 4 formed on the lever horizontal rod portion 17. The locking engagement portion 4 has the above-mentioned projections 11 formed to project perpendicularly to the lever horizontal rod portion 17, the above-mentioned engagement holes 12 formed in the respective projections 11, and tapered engagement guiding surfaces 18 formed on the respective projections 11 to facilitate the engagement of the locking engagement portion 4 with the flexible locking portion 2. The flexible locking portion 2 is formed in the rear end 1*a* of the connector housing 1 and comprises the above-mentioned locking holes 7 for the respective projections 11, the above-mentioned locking projections 13 for the engagement holes 12, a lock releasing operation portion 19 (which is pressed to perform lock releasing), the flexible locking pieces 6 which are bent when pressed, and excessive displacement prevention stoppers 20 (FIG. 2) for preventing excessive displacement of the flexible locking pieces 6.

When the locking engagement portion 4 of the operation lever 3 is to be engaged with the flexible locking portion 2, a worker moves the lever horizontal rod portion 17 of the operation lever 3 against the elastic force of the coil spring 15 and presses the lever horizontal rod portion 17 against the flexible locking portion 2 so as to make the tapered engagement guiding surfaces 18 of the projections 11 abut against the locking projections 13 of the flexible locking portion 2 respectively. If the worker further presses, as shown in FIG. 3, the flexible locking pieces 6 are bent by the tapered engagement guiding surfaces 18 so that the locking projections 13 move backward, the back wall 22 of the lever horizontal rod portion 17 advances along the respective tapered surfaces 10*a*, and at the same time the rear wall 21 of the lever horizontal rod portion 17 abuts against the horizontal surfaces 10*b*. As a result, the locking projections 13 are fitted into the respective engagement holes 12 formed in the locking engagement portion 4.

As shown in FIG. 2, when the locking engagement portion 4 of the operation lever 3 is to be released from the flexible locking portion 2, the worker presses the lock releasing operation portion 19 of the flexible locking portion 2 in the direction of arrow F. Then, the flexible locking pieces 6 begin to bend and the lever horizontal rod portion 17 begins to move so that rear wall 21 of the lever horizontal rod portion 17 abuts against the horizontal surfaces 10*b* of the respective auxiliary ribs 5 to make the movement of the operation lever 3 stop temporarily. If the pressing is continued, the flexible locking pieces 6 further continue bending to release the engagement between the engagement holes 12 and the locking projections 13 before the lock releasing operation portion 19 collides with the excessive displacement prevention stoppers 20. That is, the lock releasing is thus completed.

Further, if the lever horizontal rod portion 17 is pressed in the direction of arrow G in the drawing when the engagement holes 12 of the operation lever 3 and the locking projections 13 of the flexible locking portion 2 are in the state of engagement with each other, the engagement between the engagement holes 12 and the locking projections 13 is not released and the state of engagement is continued although the operation lever 3 and the flexible locking pieces 6 begin to move, because the above-mentioned relation is established between the auxiliary ribs 5 and the lever horizontal rod portion 17 so that the back wall 22 of the lever horizontal rod portion 17 abuts against the tapered surfaces 10*a*. Accordingly, even if the worker presses the lever horizontal rod portion 17 in the direction of arrow G by mistake, the engagement between the engagement holes 12 of the operation lever 3 and the locking projections 13 of the flexible locking portion 2 is not released.

As described above, according to the present invention, a tapered surface and a horizontal surface are formed in each auxiliary rib so that even if a worker presses the lever horizontal rod portion by mistake slantingly from the right upper rear side when the locking projections and the engagement holes are engaged with each other, the locking mechanism is not released so that loss in work can be reduced. Further, if the lock releasing operation portion is pressed from above in the state where the locking projections and the engagement holes are engaged with each other, the locking mechanism can be easily released the lock releasing can be effected with little urging-force and the lock releasing operation is made easy.

What is claimed is:

1. A connector, comprising:

a connector housing;

an operation lever pivotably disposed on said connector housing, and including a lever horizontal rod portion and an engagement portion formed on said lever horizontal rod portion;

a locking portion formed directly on said connector housing, and engaged with said engagement portion by pivoting said operation lever; and a tapered surface formed directly on said connector housing so as to confront a back wall of said lever horizontal rod portion opposite to said engagement portion to prevent disengagement of said locking portion and said engagement portion.

2. The connector of claim 1, wherein said tapered surface is formed on an auxiliary rib formed on said connector housing, said auxiliary rib having a horizontal surface which intersects said tapered surface and which is substantially parallel to a projecting direction of said engagement portion.

3. The connector of claim 2, wherein said back wall intersects a rear wall formed on said lever horizontal rod portion to be substantially parallel to the projecting direction of said engagement portion, and wherein an overlap width between an engagement hole formed in said engagement portion and a locking projection formed on said locking portion is selected so as to be larger than each of a distance from said tapered surface to said back wall and a distance from said horizontal surface to said rear wall.

* * * * *